US007775704B2

(12) United States Patent
Dahms et al.

(10) Patent No.: US 7,775,704 B2
(45) Date of Patent: Aug. 17, 2010

(54) DEVICE AND METHOD FOR CONTINUOUSLY PRODUCING EMULSIONS OR DISPERSIONS

(75) Inventors: Gerd Dahms, Duisburg (DE); Helmut Hegmann, Xanten (DE)

(73) Assignee: Kemira Oyj (FI)

( * ) Notice: Subject to any disclaimer, the term of this patent is extended or adjusted under 35 U.S.C. 154(b) by 1036 days.

(21) Appl. No.: 10/549,700

(22) PCT Filed: Mar. 21, 2003

(86) PCT No.: PCT/EP03/02996

§ 371 (c)(1),
(2), (4) Date: Aug. 16, 2006

(87) PCT Pub. No.: WO2004/082817

PCT Pub. Date: Sep. 30, 2004

(65) Prior Publication Data

US 2007/0025177 A1 Feb. 1, 2007

(51) Int. Cl.
*B01F 15/02* (2006.01)

(52) U.S. Cl. ..... 366/152.1; 366/290

(58) Field of Classification Search ..... 366/64–66, 366/192, 255–259, 307, 168.1, 117–119, 366/136–137, 171.1, 174.1, 289, 332, 144–149, 366/152.1–152.3, 152.4, 290, 291, 172.1, 366/173.1

See application file for complete search history.

(56) References Cited

U.S. PATENT DOCUMENTS

| | | | | |
|---|---|---|---|---|
| 2,361,035 | A * | 10/1944 | Klaassen | 208/29 |
| 2,475,191 | A * | 7/1949 | McFadden et al. | 521/71 |
| 3,062,627 | A * | 11/1962 | Zuiderweg | 422/257 |
| 3,579,461 | A | 5/1971 | Glaub | |
| 3,600,328 | A * | 8/1971 | Lieffers | 366/135 |
| 3,855,368 | A * | 12/1974 | Prochazka et al. | 261/81 |
| 3,951,386 | A * | 4/1976 | Small et al. | 366/142 |
| 4,123,403 | A | 10/1978 | Warner et al. | |
| 4,403,866 | A * | 9/1983 | Falcoff et al. | 366/132 |
| 4,539,139 | A | 9/1985 | Fujiwara et al. | |
| 4,880,634 | A | 11/1989 | Speiser | |
| 5,250,576 | A | 10/1993 | Shiveley et al. | |
| 5,938,581 | A | 8/1999 | Bibette et al. | |
| 6,120,175 | A * | 9/2000 | Tewell | 366/140 |
| 6,367,960 | B2 * | 4/2002 | Yamazaki et al. | 366/149 |
| 6,541,018 | B1 | 4/2003 | Simonnet et al. | |
| 6,899,452 | B2 * | 5/2005 | Hamamoto et al. | 366/152.2 |
| 6,921,193 | B2 * | 7/2005 | Fukui | 366/152.1 |
| 7,122,161 | B1 | 10/2006 | Moritz et al. | |
| 7,350,961 | B2 * | 4/2008 | Taniguchi | 366/118 |
| 2005/0099883 | A1 * | 5/2005 | Choi | 366/152.2 |

FOREIGN PATENT DOCUMENTS

| | | |
|---|---|---|
| CA | 2088217 | 7/1993 |
| EP | 0 167 825 A2 | 1/1986 |
| WO | WO 8907006 A1 * | 8/1989 |

OTHER PUBLICATIONS

JP1997192466A; Jul. 29, 1997; Machine Translation (19 pages).
JP57-035826; Aug. 8, 1980; Machine Translation (6 pages).
Dissertation von Herrn Wolfgang Schmidt, Wissenschaft und Technik Verlad, Berlin, Jul. 1998, English Translation, 6 pages.
Fachlexikon ABC Physik, Verlag Harri Deutsch, Thun und Frankfurt/Main, 2. Auflage, Band 1, 1989, English Translation, 2 pages.
Müller, R. H. et al., Pharmazeutische Technologie: Moderne Arzneiformen Wissenschaftlich Verlagsgesellschaft mbH Stuttgart 1998, pp. 357-366.
Vaessen et al., "Predicting Catastrophic Phase Inversion on the Basis of Droplet Coalescence Kinetics", Langmuir 1996, 875-882.

* cited by examiner

*Primary Examiner*—Charles E Cooley
(74) *Attorney, Agent, or Firm*—Cantor Colburn LLP

(57) ABSTRACT

A device for continuously producing emulsions or dispersions while excluding air comprises a mixing vessel, which is closed on all sides and which has supply tubes and discharge tubes for introducing and discharging fluid substances or compositions, and also an impeller, which permits an agitating input into the emulsion or dispersion without generating cavitation forces and without high-pressure homogenization. For preparing the cosmetic emulsions of the invention, as well, emulsifiers are generally used.

3 Claims, No Drawings

DEVICE AND METHOD FOR CONTINUOUSLY PRODUCING EMULSIONS OR DISPERSIONS

BACKGROUND OF THE INVENTION

The invention relates to a device and to a method for continuously producing emulsions or dispersions, particularly for producing nanoemulsions.

Emulsions and dispersions are generally produced batchwise in agitated reactors. In that case the requisite amounts of the ingredients are metered into a mixing vessel and emulsified or dispersed with high agitated input. Use is made generally for this purpose of high-performance agitators which permit the generation of cavitation forces. Alternatively a high-pressure homogenization is carried out. Monitoring of the emulsions and dispersions produced, and of the method, takes place generally only on the finished product of the corresponding mixture batch. Continuous checking of the production operation is generally not possible.

Furthermore, varying the quantities of product is possible only to a very limited extent, since in the case of a batch mixer the possible batch size is situated within a narrowly limited range. The minimum batch size must not in general be less than half of the maximum batch size.

With a view to sterile processing as well a batchwise method is problematic. In general, work takes place in open agitated tanks, so that contamination from the outside cannot be excluded. Where operation is to take place with air excluded, a costly and inconvenient method is needed for evacuating the mixing vessels in order to work under reduced pressure.

Furthermore, batch mixing devices must be of large design in order to be able to generate appropriate amounts of product. This involves considerable investment costs. Moreover, the high agitated input leads to high energy costs. Particularly for the production of nanoemulsions, especially solid lipid nanoparticles (SLN), there has to date been a lack of industrial production methods. Consequently it has not been possible to date for SLN to become established to any great extent.

SLN dispersions are customarily produced by high-pressure homogenization. Depending on the lipid and surfactant used, different particle forms are obtained. A distinction is made between hot homogenization and cold homogenization. In the case of hot homogenization, after the lipid has been melted and the active compound has been dissolved or dispersed, dispersion takes place in a hot surfactant solution. This preemulsion is then subjected to high-pressure homogenization and is then converted into a hot O/W nanoemulsion. After cooling and recrystallization, solid lipid nanoparticles (SLN) are obtained. In the case of cold homogenization, after the lipid has been melted and the active compound has been dissolved or dispersed, the drug/lipid mixture is solidified and then ground into microparticles. The particles are subsequently suspended in a cold surfactant solution and the particle suspension is subjected to high-pressure homogenization. The cavitation forces and shearing forces that occur during high-pressure homogenization are sufficient to crush the lipid microparticles into lipid nanoparticles. In the case of hot homogenization, the preemulsion is generally homogenized in the hot state in a plunger/slot homogenizer at pressures between 200 bar and a maximum of 1500 bar. This produces an emulsion whose lipid phase, on cooling, recrystallizes into SLN. For a description of the methods reference may be made to R. H. Müller, G. E. Hildebrandt, Pharmazeutische Technologie: Moderne Arzneiformen [Pharmaceutical technology: modern drug forms], wissenschaftliche Verlagsgesellschaft mbH, Stuttgart 1998, 2nd edition, pages 357 to 366.

The SLN technology serves in particular the application of active pharmaceutical, cosmetic and/or food technology compounds in a solid vehicle. The active compound vehicle may be adapted to the particular utility, and allows appropriate metering and release of the active compound. SLN represent an alternative carrier system to emulsions and liposomes. The nanoparticles may comprise active hydrophilic or hydrophobic pharmaceutical compounds and may be administered orally or parenterally. The matrix material used in this case, in contrast to the known emulsions, is a solid lipid. To ensure high bioacceptance and good in vivo breakdown, predominantly, physiologically compatible lipids or lipids comprising physiological components such as glycerides from endogenous fatty acids are used. In the course of production, as with the production of emulsions and dispersions, it is usual to use emulsifiers or surfactants as well.

One method for producing SLN dispersions is described for example in EP-B-0 167 825. The lipid nanopellets are produced by dispersing the melted lipid with water using a high-speed agitator. The desired particle size distribution is subsequently set by means of an ultrasound treatment. Agitation takes place generally at speeds in the region of 20 000 $min^{-1}$.

The production of solid lipid nanoparticles with a low average particle diameter in accordance with the prior art is costly and inconvenient, since, generally, high-pressure homogenizers have to be used. Mere agitation at high speed achieves only relatively large average particle diameters of approximately 3 μm.

BRIEF SUMMARY OF THE INVENTION

It is an object of the present invention to provide a continuous, low-cost and convenient method for producing emulsions and dispersions that permits in particular the production of nanoemulsions with controlled particle size. The device and the method ought to permit in-process/online quality control. Moreover, production ought to be simplified and accelerated as compared with conventional batch methods. It ought also to be possible to produce variable amounts of emulsions or dispersions. Moreover, it ought to be possible without cost or complication to operate in the absence of air.

This object is achieved in accordance with the invention by means of a device for continuously producing emulsions or dispersions while excluding air, comprising a mixing vessel, which is closed on all sides and which has supply tubes and discharge tubes for introducing and discharging fluid substances or compositions, and also an impeller, which permits an agitating input into the emulsion or dispersion without generating cavitation forces and without high-pressure homogenization.

DETAILED DESCRIPTION OF THE INVENTION

This object is achieved in accordance with the invention, moreover, by a method for continuously producing emulsions and dispersions while excluding air, in which at least two fluid streams of at least two phases of the emulsions or dispersions are metered separately and continuously into a mixing vessel which is closed on all sides, and in which they are converted, with agitated input, into an emulsion or dispersion, and the emulsion/dispersion is discharged continuously from the mixing vessel, the agitated input taking place without generating cavitation forces and without high-pressure homogenization.

In the device of the invention the mixing vessel is closed on all sides. This means that, apart from supply lines and discharge lines and also agitator passages or passages for analytical sensors, the mixing vessel is closed. Where both the supply tubes and the discharge tubes are full of fluid substances and there is the impeller and, if desired, analytical sensors, the mixing vessel is sealed against ingress of air or oxygen. This interpretation of the mixing vessel is encompassed by the expression "closed on all sides".

The impeller permits a mechanical agitated input into the emulsion or dispersion without generating cavitation forces and without high-pressure homogenization. In preferred impellers, suitable agitating elements are disposed on an agitator shaft, which is rotated. With regard to the impeller, the systems in question may be those known as rotor/stator systems, in which a rotor is moved under motor operation. Generally speaking, the housing, which may be provided with internals such as breakers, serves as the stator. Suitable agitators include, for example, paddle stirrers, which may be provided, if appropriate, with strippers. Furthermore, extruders and other suitable agitators such as planetary stirrers, anchor stirrers, cross-arm stirrers, propellers, blade stirrers, dissolver disks or Intermig devices may be used. Further suitable agitator configurations are known to the skilled worker.

The impeller is operated such that the agitated input into the emulsion or dispersion takes place without generating cavitation forces and without high-pressure homogenization.

In the mixing vessel, moreover, there may if desired be grinding tools such as grinding beads or balls. Suitable grinding tools are known to the skilled worker.

The mixing vessel may have any suitable geometry, provided it permits appropriate mixing of the fluid substances or compositions and/or of the phases of the emulsions and dispersions that are to be produced. Suitable geometries are known to the skilled worker. Preferably the mixing vessel has a substantially cylindrical form, the axis of the impeller lying in the cylinder axis, and the supply tubes and discharge tubes being disposed substantially perpendicular to the cylinder axis in the top and bottom peripheral region of the cylinder, at a distance from one another. Viewed along the cylinder axis, therefore, the supply tubes and discharge tubes are disposed, remote as far as possible from one another, in positions along the cylinder periphery. They are disposed substantially perpendicular to the cylinder axis. Deviations of ±10°, preferably ±5°, from this are possible. The arrangement may be adapted to the practical requirements. Preferably the fluid substances or compositions are supplied or introduced separately into the first mixing vessel. The corresponding supply tubes preferably protrude somewhat into the mixing vessel. It is also possible to provide a premixing stage for the fluid substances or compositions. When producing an oil/water emulsion or water/oil emulsion, for example, the individual components of the oil phase and the individual components of the water phase can be premixed separately. It is also possible to combine the oil phase and the water phase in a premixing stage and to introduce them jointly into the mixing vessel. Customarily the oil phase and the water phase or corresponding other phases are fed separately from one another into the mixing vessel. One or more supply tubes and discharge tubes may be provided. Usually two or more, especially two or three, supply tubes and one discharge tube are provided. The size of the mixing vessel may be selected in accordance with the prevailing practical requirements. On a laboratory scale the internal volume (free volume) of the mixing vessel is preferably 2 to 70 ml, more preferably 3 to 50 ml, in particular 5 to 15 ml. On a pilot plant scale the internal volume is preferably 70 to 500 ml, more preferably 100 to 400 ml. On an industrial scale the volume is preferably more than 500 ml; for example, 500 to 50 000 ml.

On the laboratory scale it is possible for example to use mixing vessels having a volume of approximately 7 ml, a cylindrical form, an internal diameter of 20 mm, and an internal height of 25 mm. The internal volume may also be controlled by the thickness and/or diameter of the rotor axle. Thus it is also possible to obtain configurations corresponding to an annular chamber reactor. The residence times in the first mixing vessel are preferably 2 to 600 seconds, more preferably 4 to 100 seconds, in particular 8 to 40 seconds.

It is possible in accordance with the invention to produce the desired emulsions and dispersions continuously with just one mixing vessel. Preferably, though, at least two mixing vessels are arranged in series with one another, the discharge from the first mixing vessel being introduced into the second mixing vessel, and a further supply tube into the second mixing vessel being provided. The second (and subsequent) mixing vessel also has an agitator mechanism, as described. It is also possible, correspondingly, to provide longer cascades of mixing vessels, the discharge from one mixing vessel being supplied to the next mixing vessel, and, if desired, respective further inputs may be made into the further mixing vessel. It is preferred to operate with two or three, in particular with two, mixing vessels placed in series.

In accordance with the invention it is possible to condition one or more of the mixing vessels thermally independently of one another. Thermal conditioning may be achieved by cooling or heating jackets or by integrating the mixing vessel into an oven or a cryostat. Suitable apparatus for heating/cooling or thermally conditioning the mixing vessels is known to the skilled worker.

Where two mixing vessels placed in series are used, the proportion of the incoming streams in the first mixing vessel is set such that mixing in the first mixing vessel is operated in the viscoelastic or highly viscoelastic range. The viscoelastic range identifies the range within which the viscoelastic liquids exhibit non-Newtonian liquid behavior. For a description of viscoelasticity, reference may be made to Römpp, Chemielexikon, 9th edition, entry "Viscoelasticity".

The relationship between the viscosity of an emulsion or dispersion and the volume fraction of the disperse phase usually corresponds to an exponential function. The important viscoelastic range within which it is preferred to operate in accordance with the invention is the range within which increasing volume fraction of the disperse phase is accompanied by a very sharp increase in the viscosity. In the case of a two-phase emulsion, the weight ratio of the phases is preferably selected in a range from 1:15 to 15:1, more preferably 1:5 to 5:1, very preferably 1:2 to 2:1, in particular 1:1.5 to 1.5:1. Particularly in the case of oil/water (O/W) emulsions, water/oil (W/O) emulsions, and polyol/oil (P/O) emulsions, the weight fractions of the corresponding phases are preferably within this range.

In the case of a succession of two mixing vessels, therefore, operation takes place at high viscosity in the first stage and at low viscosity in the subsequent, second stage. Adjustment to a finely divided emulsion or dispersion is achieved in the first reactor, while dilution to the ultimate concentration of the product takes place in the second mixing vessel. Since the second mixing vessel is introduced in this case with a supplementary amount of at least one of the phases, or with a further phase, the residence time in the second mixing vessel is correspondingly shorter, provided both mixing vessels have the same internal volume.

By observing the quantitative proportion of the two phases in the first mixing vessel it is possible to achieve a very strong mixing action even with the input of low shearing energies. Without being tied to any theory, the microemulsion obtained when the phases are mixed can be understood as being a system of two interpenetrating networks, so that the microemulsion displays one-phase behavior.

In accordance with the invention at least one sensor is disposed in the discharge tubes of the mixing vessels or in at least one discharge tube of one mixing vessel for continuously measuring the temperature, conductivity and/or optical properties of the emulsion or dispersion. Such a sensor is generally provided in the vicinity of the mixing vessel in the discharge tube. Suitable sensors for determining electrical conductivity, temperature or optical properties such as turbidity are known to the skilled worker. When assessing the optical properties it is also possible for a window to be provided, allowing optical or visual monitoring of the clarity or turbidity of the emulsion/dispersion. Machine-assisted optical methods include laser light scattering and absorbance measurements.

Optical methods of determining the particle size in the emulsions or dispersions may likewise be used for operational monitoring. A further possibility is to carry out viscosity measurements, by the method of Brookfield, for example, using an inline technique, for example. Visual/optical monitoring can be performed by means of suitable, trained personnel. An additional possibility is to determine the amount of energy input by the agitator. Here as well, it is possible to respond rapidly to deviations in the input energy, since this may indicate an alteration in the composition of the emulsion/dispersion. All in all, the continuous determination of one or more of the stated parameters allows continuous operational monitoring and continuous monitoring of the composition of the emulsion or dispersion. Quality assurance in production is hence considerably improved and/or simplified. This is very important particularly in the case of pharmaceutical products.

By way of the conductivity it is possible to draw conclusions concerning the phase volume ratio. By measuring the conductivity, therefore, alterations in the composition of the emulsion and/or in the phase volumes are easy to determine. Operational monitoring is preferably carried out online—that is, continuously during the production method. This allows an immediate response to deviations in the compositions of the emulsions or dispersions. An alteration, for example, in the volume flows of the phases employed produces a different phase volume ratio in the mixing vessel, leading to an altered conductivity. By determining the conductivity it is also possible, for example, to control the adjustment of the volume flows in turn, in order to ensure constant volume flows.

According to one embodiment of the invention the supply of the fluid substances and the agitated input and, if desired, the thermal conditioning of the mixing vessels are under computer control. Via a central computer it is therefore possible to control and monitor all operational parameters. The measured values supplied by the sensors may likewise be fed to the computer and evaluated with computer support.

The different fluid substances are metered, for example, by means of suitable pumps. Pumps of this kind are known to the skilled worker. They are preferably independent of the opposing pressure and can be driven in fine gradation. Examples of suitable pumps are gear pumps, peristaltic pumps and other suitable pumps. The combination of these pumps with the mixing vessels employed in accordance with the invention allows bubble-free and air-free production of emulsions. Over the entire path of the fluid substances the ingress of air is made more difficult or impossible since all steps of the method are carried out in a closed system. This is a further advantage of the method of the invention, allowing costly and inconvenient steps such as evacuation of the emulsions to be dispensed with.

The device of the invention can be operated at low pressure, in particular at a pressure in the range from 1 to 10 bar, more preferably 1 to 1.5 bar. The method is carried out correspondingly at a pressure within this range.

The mixing vessels and lines may be constructed from any suitable materials. Examples of suitable inert materials are plastics, steels such as V2A or V4A steel, or copper. Suitable materials of construction are known to the skilled worker.

It is possible in accordance with the invention to configure the device in a modular construction. This means that a plurality of mixing vessels may be arranged simply in series or else in parallel. The device may also be constructed on a modular principle from individual components. These individual components may be, for example, pumps, mixing vessels, sensor elements, agitator motors, thermal conditioning units, and connecting elements. All pumps and agitator motors may be driven via a central computer.

The agitators, the size of the mixing vessels, and the size of the input streams are selected in accordance with the practical requirements and can be determined by means of simple preliminary experiments. Particularly in the case of the two-stage procedure, it is possible to operate at high viscosity in the first stage and at low viscosity in the second stage, thereby providing access to a multiplicity of different emulsions or dispersions in a simple way.

In order to be able to operate in the viscoelastic, preferably highly viscoelastic, range in the first mixing vessel, thickeners may be added if desired to the individual phases or fluid substances or compositions. This makes it possible in a simple way to enter into an appropriate viscosity range, allowing the production of finely divided emulsions and dispersions with low agitated input.

The advantages of the continuous method of the invention over batch methods are many: the production of the emulsions or dispersions is substantially accelerated. For example, the preparation of 1 liter of an emulsion in a continuous batch method, with heating, cooling and homogenizing, lasts at least about 1.5 hours. In the course of this method, it is not possible to make statements concerning the quality of the emulsions or dispersions. The method of the invention allows a corresponding production in not more than about 15 minutes, during which it is possible to analyze and monitor the emulsions or dispersions in the method (in-process product control). The amounts of product can be varied in a simple way via the length of the production period. Accordingly, very different batch sizes can be realized in a simple way. By varying the supply streams into the mixing vessels it is possible in a simple way to vary the composition of the emulsions or dispersions.

Since operation takes place in closed pipeline systems and closed mixing vessels, sterile processing is a possibility. Contamination from the outside is ruled out. The configuration of the device or unit may be smaller and more lightweight than in the case of a batch unit, hence allowing considerable savings in terms of investment costs. There is generally no need to use coolants, since the temperature can be controlled, for example, by way of the phase which is introduced into the second mixing vessel. The space requirement is also substantially lower. As a result of the continuous procedure, energy savings are possible as well, as have already been described above. The accuracy of the available metering pumps allows very high accuracies with regard to the composition of the emulsions or dispersions. Customary metering pumps allow accuracies in the range from ±0.5% up to ±0.15%.

The production of nanoemulsions having particle sizes or droplet sizes in the range from 15 to 300 nm, to a maximum of 1000 nm, is possible in a simple way.

In comparison to known methods, substantially more finely divided emulsions can be produced with substantially less cost and inconvenience.

As compared with discontinuous, batchwise production the amount of emulsifier used can be reduced significantly. It is frequently possible to operate with less than half the customary amount of emulsifier.

Through selection of suitable impellers, the device of the invention can be adapted readily to a multiplicity of applications.

The small size of the device of the invention makes it easier and quicker to clean. When there is a change in the emulsions or dispersions to be produced, it is also possible to dispense with cleaning. In this case the substances or flows employed are varied in accordance with the new product composition, and the initial discharge from the mixing vessels is discarded. The alteration in the emulsion until the constant, desired product composition is obtained can again be monitored via online operational monitoring.

The device of the invention and the method of the invention are applicable to a multiplicity of emulsions or dispersions. In accordance with the invention, single emulsions or multiple emulsions in particular are produced. Examples are OW emulsions, WO emulsions, PO emulsions, multiple emulsions, LC gels, liposomes or pearlescent concentrates. The air-free operation allows active compounds that are sensitive to oxidation to be introduced advantageously into the emulsions.

The method of the invention allows the production of high-viscosity systems such as gels. Liposomes may likewise be produced at low pressure. Hence the production of emulsions, ointments and gels for all customary pharmaceutical, cosmetic, food technology or detergent segments is possible. Other fields of application as well are accessible in accordance with the invention.

Nanoemulsions feature emulsion droplets having an average diameter in the range from 5 to 1000 nm, preferably 15 to 300 nm. When producing two-phase emulsions, a finely divided primary emulsion is generally produced in the first mixture, under high-viscosity conditions, and in the second mixing vessel this primary emulsion is diluted with one of the two phases to the desired end concentration. For example, an O/W emulsion can be produced in the first mixing vessel, with high oil fractions, the resultant primary emulsion being diluted in the second mixing vessel, with addition of water, to the desired end concentration. With this procedure, dilution takes place in the second mixing device with the major portion of the external phase. When producing multiple emulsions it is possible, for example, to produce a PO emulsion in the first mixing vessel and to convert it, together with water, into a POW emulsion in the second mixing vessel. It is possible in each case to use impellers and speeds that are adapted to the system.

To produce an aqueous active compound vehicle nanodispersion, comprising at least one active pharmaceutical, cosmetic and/or food technology compound, it is possible first of all to mix the active compound and the lipid-based active compound vehicle, and at least one emulsifier which forms lamellar structures, at a temperature above the melting or softening point of the active compound vehicle. In this case a phase B is formed. This phase B can then be mixed with an aqueous phase A at a temperature above the melting or softening point of the active compound vehicle. This mixing is carried out, for example, in the first mixing vessel. The mixed phase can then be diluted with an aqueous phase to the desired end concentration. This dilution can be carried out in the second mixing vessel.

Active compound vehicle particles used are lipid-based particles. They include lipids and lipid-like structures. Examples of suitable lipids are the mono-, di- and triglycerides of saturated straight-chain fatty acids having 12 to 30 carbon atoms, such as lauric acid, myristic acid, palmitic acid, stearic acid, arachidic acid, behenic acid, lignoceric acid, cerotic acid and melesinic acid, and their esters with other polyfunctional alcohols such as ethylene glycol, propylene glycol, mannitol, sorbitol, saturated fatty alcohols having 12 to 22 carbon atoms such as lauryl alcohol, myristyl alcohol, cetyl alcohol, stearyl alcohol, arachidyl alcohol, behenyl alcohol, saturated wax alcohols having 24 to 30 carbon atoms such as lignoceryl alcohol, ceryl alcohol, cerotyl alcohol and myricyl alcohol. Preference is given to mono-, di- and triglycerides, fatty alcohols, their esters or ethers, waxes, lipid peptides or mixtures thereof. Use is made in particular of synthetic mono-, di- and triglycerides as individual substances or in the form of a mixture, such as in the form of a hard fat, for example. Examples of glyceryl tri-fatty acid esters are glyceryl trilaurate, glyceryl trimyristate, glyceryl palmitate, glyceryl tristearate or glyceryl tribehenate. Examples of suitable waxes are cetyl palmitate and cera alba (bleached wax, DAB [German Pharmacopeia] 9). Other lipids which can be used include polysaccharides with or in certain cases without polyalkyl acrylates, polyalkyl cyanoacrylates, polyalkylvinylpyrrolidones, acrylic polymers, polylactic acids or polylactides.

The amount of active compound vehicle particles, based on the total aqueous active compound vehicle dispersion, is preferably 0.1% to 30% by weight, more preferably 1% to 10% by weight. In addition to the lipids it is possible to use dispersion stabilizers. They can be used, for example, in amounts of 0.01% to 10% by weight, preferably 0.05% to 5% by weight. Examples of suitable substances are surfactants, especially ethoxylated sorbitan fatty acid esters, block polymers and block copolymers (such as poloxamers and poloxamines, for example), polyglyceryl ethers and esters, lecithins of various origin (for example, egg lecithin or soybean lecithin), chemically modified lecithins (for example, hydrogenated lecithin), and also phospholipids and sphingolipids, mixtures of lecithins with phospholipids, sterols (for example, cholesterol and cholesterol derivatives and also stigmasterol), esters and ethers of sugars or sugar alcohols with fatty acids or fatty alcohols (for example, sucrose monostearate), sterically stabilizing substances such as poloxamers and poloxamines (polyoxyethylene-polyoxypropylene block polymers), ethoxylated sorbitan fatty acid esters, ethoxylated mono- and diglycerides, ethoxylated lipids and lipoids, ethoxylated fatty alcohols or fatty acids, and charge stabilizers or charge carriers such as, for example, dicetyl phosphate, phosphatidyl glycerol, and saturated and unsaturated fatty acids, sodium cholate, sodium glycol cholate, sodium taurocholate or mixtures thereof, amino acids or peptizers such as sodium citrate (see J. S. Lucks, B. W. Müller, R. H. Müller, Int. J. Pharmaceutics 63, pages 183 to 189 (1990)), viscosity enhancers such as cellulose ethers and cellulose esters (for example, methylcellulose, hydroxyethylcellulose, hydroxypropylcellulose, sodium carboxymethylcellulose), polyvinyl derivatives such as polyvinyl alcohol, polyvinylpyrrolidone, polyvinyl acetate, alginates, polyacrylates (for example, Carbopol), xanthans, and pectins.

As aqueous phase A it is possible to use water, aqueous solutions or mixtures of water with water-miscible liquids such as glycerol or polyethylene glycol. Further, additional components for the aqueous phase are, for example, mannose, glucose, fructose, xylose, trehalose, mannitol, sorbitol, xylitol or other polyols such as polyethylene glycol and also electrolytes such as sodium chloride. These additional components can be used in an amount of 0.5% to 60%, for example, 1% to 30% by weight, based on the aqueous phase A.

If desired it is possible, furthermore, to use viscosity enhancers or charge carriers as are described in EP-B-0 605 497.

As emulsifiers which form lamellar structures it is possible to use natural or synthetic products. The use of surfactant mixtures is a further possibility. Examples of suitable emulsifiers are the physiological bile salts such as sodium cholate, sodium dehydrocholate, sodium deoxycholate, sodium glycocholate, and sodium taurocholate. Animal and plant phospholipids such as lecithins together with their hydrogenated forms, and also polypeptides such as gelatin, with their modified forms, may also be used.

Suitable synthetic surface-active substances are the salts of sulfosuccinic esters, polyoxyethylene acid betaine esters, acid betaine esters and sorbitan ethers, polyoxyethylene fatty alcohol ethers, polyoxyethylene stearic esters, and corresponding mixture condensates of polyoxyethylene-meth-polyoxypropylene ethers, ethoxylated saturated glycerides, partial fatty acid glycerides and polyglycides. Examples of suitable surfactants are Biobase® EP and Ceralution® H.

Examples of suitable emulsifiers are, additionally, glyceryl esters, polyglyceryl esters, sorbitan esters, sorbitol esters, fatty alcohols, propylene glycol esters, alkylglucositol esters, sugar esters, lecithin, silicone copolymers, lanolin, and mixtures or derivatives thereof. Glyceryl esters, polyglyceryl esters, alkoxylates and fatty alcohols, and also isoalcohols, may be derived, for example, from castor fatty acid, 12-hydroxystearic acid, isostearic acid, oleic acid, linoleic acid, linolenic acid, stearic acid, myristic acid, lauric acid, and capric acid. Besides the stated esters it is also possible for succinates, amides or ethanolamides of the fatty acids to be present. Particularly suitable fatty acid alkoxylates are the ethoxylates, propoxylates or mixed ethoxylates/propoxylates.

Use is also made of emulsifiers in the production of the inventive cosmetic emulsions. Examples of suitable emulsifiers are glyceryl esters, polyglyceryl esters, sorbitan esters, sorbitol esters, fatty alcohols, propylene glycol esters, alkylglucositol esters, sugar esters, lecithin, silicone copolymers, lanolin, and their mixtures or derivatives. Glyceryl esters, polyglyceryl esters, alkoxylates and fatty alcohols, and also isoalcohols, may be derived, for example, from castor fatty acid, 12-hydroxystearic acid, isostearic acid, oleic acid, linoleic acid, linolenic acid, stearic acid, myristic acid, lauric acid, and capric acid. Besides the stated esters it is also possible for succinates, amides or ethanolamides of the fatty acids to be present. Particularly suitable fatty acid alkoxylates are the ethoxylates, propoxylates or mixed ethoxylates/propoxylates. Furthermore, it is possible to use emulsifiers which form lamellar structures. Examples of suitable emulsifiers are the physiological bile salts such as sodium cholate, sodium dehydrocholate, sodium deoxycholate, sodium glycocholate, and sodium taurocholate. Animal and plant phospholipids such as lecithins together with their hydrogenated forms, and also polypeptides such as gelatin, with their modified forms, may also be used.

Suitable synthetic surface-active substances are the salts of sulfosuccinic esters, polyoxyethylene acid betaine esters, acid betaine esters and sorbitan ethers, polyoxyethylene fatty alcohol ethers, polyoxyethylene stearic esters, and corresponding mixture condensates of polyoxyethylene-meth-polyoxypropylene ethers, ethoxylated saturated glycerides, partial fatty acid glycerides and polyglycides. Examples of suitable surfactants are Biobase® EP and Ceralution® H.

Lipids and emulsifiers are used preferably in a weight ratio of 50:1 to 2:1, preferably 15:1 to 30:1.

The active pharmaceutical, cosmetic and/or food technology compounds are used, based on phase B, in an amount of preferably 0.1% to 80% by weight, more preferably 1% to 10% by weight.

Listed below by way of example are active pharmaceutical compounds, which may be used, for example, in free form, as the salt, or as esters or ethers:

analgesics/anti-inflammatories, such as morphine, codeine, piritramide, fentanyl and fentanyl derivatives, levomethadone, tramadol, diclofenac, ibuprofen, indometacin, naproxen, piroxicam, penicillamine; antiallergics, such as pheniramine, dimetindene, terfenadine, astemizole, loratadine, doxylamine, meclozine, bamipine, clemastine; antibiotics/chemotherapeutics, such as polypeptide antibiotics such as colistin, polymyxin B, teicoplanin, vancomycin; antimalarials such as quinine, halofantrin, mefloquine, chloroquine, virostatics such as ganciclovir, foscarnet, zidovudine, aciclovir and others such as dapsone, fosfomycin, fusafungine, trimetoprim; antiepileptics, such as phenyloin, mesuximide, ethosuximide, primidone, phenobarbital, valproic acid, carbamazepine, clonazepam; antimycotics, such as internals: nystatin, natamycin, amphotericin B, flucytosine, miconazole, fluconazole, itraconazole; and externals: clotrimazole, econazole, tioconazole, fenticonazole, bifonazole, oxiconazole, ketoconazole, isoconazole, tolnaftate; corticoids (internals), such as aldosterone, fludrocortisone, betamethasone, dexamethasone, triamcinolone, fluocortolone, hydroxycortisone, prednisolone, prednylidene, cloprednol, methylprednisolone; dermatologic agents, such as antibiotics: tetracycline, erythromycin, neomycin, gentamycin, clindamycin, framycetin, tyrothricin, chlortetracycline, mupirocin, fusidic acid; virostatics as above, and also: podophyllotoxin, vidarabine, tromantadine; corticoids as above, and also: amcinonide, fluprednidene, aclometasone, clobetasol, diflorasone, halcinonid, fluocinolone, clocortolone, flumethasone, difluocortolone, fludroxycortide, halometasone, desoximetasone, fluocinolide, fluocortin butyl, fluprednidene, prednicarbate, desonide; diagnostic agents, such as radioactive isotopes such as Te99m, In111 or I131, covalently bonded to lipids or lipoids or other molecules or in complexes, highly substituted iodine-containing compounds such as, for example, lipids; hemostyptics, such as blood coagulation factors VIII, IX; hypnotics, sedatives, such as cyclobarbital, pentobarbital, phenobarbital, methaqualone, benzodiazepines (flurazepam, midazolam, netrazepam, lormetazepam, flunitrazepam, trazolam, brotizolam, temazepam, loprazolam); hypophyseal hormones, hypothalamus hormones, regulatory peptides and their inhibitors, such as corticotrophin, tetracosactide, chorionic gonadotropin, urofollitropin, urogonadotropin, somatropin, metergoline, bromocriptine, terlipressin, desmopressin, oxytocin, argipressin, ornipressin, leuprorelin, triptorelin, gonadorelin, buserelin, nafarelin, goselerin, somatostatin; immunotherapeutics and cytokines, such as dimepranol 4-acetamidobenzoate, thymopentin, α-interferon, β-inteferon, filgrastim, interleukins, azathioprine, ciclosporin; local anesthetics, such as internals: butanilicaine, mepivacaine, bupivacaine, etidocaine, lidocaine, articaine, prilocalne; and externals: propitocaine, oxybuprocaine, etracaine, benzocaine; antimigraine agents, such as proxibarbal, lisuride, methysergide, dihydroergotamine, clonidine, ergotamine, pizotifen; narcotics, such as methohexital, propofol, etomidate, ketamine, alfentanil, thiopental, droperidol, fentanyl; parathyroid hormones, calcium metabolism regulators, such as dihydrotachysterol, calcitonin, clodronic acid, etidronic acid; ophthalmic agents, such as atropine, cyclodrine, cyclopentolate, homatropine, tropicamide, scopolamine, pholedrine, edoxudine, idoxuridine, tromantadine, aciclovir, acetazolamide, diclofenamid, carteolol, timolol, metipranolol, betaxolol, pindolol, befunolol, bupranolol, levobunolol, carbachol, pilocarpine, clonidine, neostigmine; psychopharmaceuticals, such as benzodiazepines (lorazepam, diazepam), clomethiazole; thyroid gland therapeutic agents, such as 1-thyroxine, carbimazole, thiamazole, propylthiouracil; sera, immunoglobulins, vaccines, such as immunoglobulins generally and specifically such as hepatitis types, German measles, cytomegalovirus, rabies; TBE, Varicella Zoster, tetanus, rhesus factors, immune sera such as botulism antitoxin, diphtheria, gas gangrene, snake poison, scorpion poison, vaccines, such as influenza, tuberculosis, cholera, diphtheria, hepatitis types, TBE, German measles, *Haemophilus influenzae*, measles, *Neisseria*, mumps, poliomyelitis, tetanus, rabies, typhus; sex hormones and their inhibitors, such as anabolics, androgens, antiandrogens, gestagens, estrogens, antiestrogens (tamoxifen etc.); cytostatics and metastase inhibitors, such as alkylating agents such as nimustine, melphalan, carmustine, lomustine, cyclophosphamide, ifosfamide, trofosfamide, chlorambucil, busulfan, treosulfan, prednimustine, thiotepa, antimetabolites such as cytarabine, fluorouracil, methotrexate, mercaptopurine, tioguanine, alkaloids such as vinblastin, vincristin, vindesin; antibiotics such as aclarubicin, bleomycin, dactinomycin, daunorubicin, epirubicin, idarubicin, mitomycin and plicamycin, complexes of transition group elements (for example Ti, Zr, V, Nb, Ta, Mo, W, Pt) such as carboplatin, cisplatin, and metallocene compounds such as titanocene dichloride, amsacrine, dacarbazine, estramustine, etoposide, hydroxycarbamid, mitoxantrone, procarbazine and temiposide, alkylamido phospholipids (described in J. M. Zeidler, F. Emling, W. Zimmermann and H. J. Roth, Archiv der Pharmazie, 324 (1991), 687), and ether lipids such as hexadecylphosphocholine, ilmofosine and analogs, described in R. Zeisig, D. Arndt and H. Brachwitz, Pharmazie 45 (1990), 809 to 818.

Examples of further suitable active compounds include diclofenac, ibuprofen, acetylsalicylic acid, salicylic acid, erythromycin, ketoprofen, cortisone, and glucocorticoids.

Additionally suitable are active cosmetic compounds, which in particular are sensitive to oxidation or hydrolysis, such as polyphenols, for example. Mention may be made here of catechins (such as epicatechin, epicatechin 3-gallate, epigallocatechin, epigallocatechin 3-gallate), flavonoids (such as luteolin, apigenin, rutin, quercitin, fisetin, kaempherol, rhamnetin), isoflavones (such as genistein, daidzein, glycitein, prunetin), coumarins (such as daphnetin, umbelliferone), emodin, resveratrol, and oregonin.

Suitable vitamins include retinol, tocopherol, ascorbic acid, riboflavin, and pyridoxine.

Suitability is possessed, furthermore, by whole extracts from plants that include above molecules or classes of molecule.

According to one embodiment of the invention the active compounds are sunscreen agents. They may be present in the form of organic sunscreen agents at room temperature (25° C.) in liquid or solid form. Suitable sunscreen agents (UV filters) are, for example, compounds based on benzophenone, diphenyl cyanoacrylate or p-aminobenzoic acid. Specific examples are (INCI or CTFA names) Benzophenone-3, Benzophenone-4, Benzophenone-2, Benzophenone-6, Benzophenone-9, Benzophenone-1, Benzophenone-11, Etocrylene, Octocrylene, PEG-25 PABA, Phenylbenzimidazole Sulfonic Acid, Ethylhexyl Methoxycinnamate, Ethylhexyl Dimethyl PABA, 4-Methylbenzylidene Camphor, Butyl Methoxydibenzoylmethane, Ethylhexyl Salicylate, Homosalate, and Methylene-Bis-Benzotriazolyl Tetramethylbutylphenol (2,2'-methylene-bis{6-(2H-benzotriazol-2-yl)-4-(1,1,3,3-tetramethylbutyl)phenol}, 2-hydroxy-4-methoxybenzophenone-5-sulfonic acid, and 2,4,6-trianilino-p-(carbo-2'-ethylhexyl-1'-oxy)-1,3,5-triazine.

Further organic sunscreen agents are octyltriazones, avobenzones, octyl methoxycinnamates, octyl salicylates, benzotriazoles, and triazines.

According to a further embodiment of the invention, active compounds used are active antidandruff agents, such as are customarily present in cosmetic or pharmaceutical formulations. One example thereof is Piroctone Olamine (1-hydroxy-4-methyl-6-(2,4,4-dimethylpentyl)-2-(1H)-pyridone, preferably in combination with 2-aminoethanol (1:1)). Further suitable agents for treating dandruff are known to the skilled worker.

Further possible ingredients of the emulsions are hydrophilically coated micropigments, electrolytes, glycerol, polyethylene glycol, propylene glycol, barium sulfate, alcohols, waxes, metal soaps, magnesium stearate, vaseline or other ingredients. By way of example it is possible additionally to add perfumes, perfume oils or perfume aromas. Examples of suitable active cosmetic compounds include polyphenols and derivatives thereof. Suitable vitamins are retinol, tocopherol, ascorbic acid, riboflavin, and pyridoxine.

Suitable active compounds further include, for example, all oxidation-sensitive active compounds such as tocopherol.

According to one further embodiment of the invention, organic dyes are used as or in lieu of active compounds.

The method of the invention can be used to produce all known and suitable water-in-oil emulsions or oil-in-water emulsions. For this purpose the emulsifiers and further ingredients described above can be employed. A further possibility is the production of polyol-in-oil emulsions. In this case it is possible to use any desired and suitable polyols.

The fractions of the two main phases in the emulsions can be varied within wide ranges. By way of example, 5% to 95% by weight, preferably 10% to 90% by weight, and in particular 20% to 80% by weight of the respective phases are present, the total amount being 100% by weight.

The P/O emulsion described can also be emulsified in water or a water-in-oil emulsion. The result is a polyol-in-oil-in-water emulsion (P/O/W emulsion), comprising at least one emulsion as described and, in addition, at least one aqueous phase. Multiple emulsions of this kind may correspond in their construction to the emulsions described in DE-A-43 41 113.

When the P/O emulsion of the invention is introduced into water or aqueous systems, the weight ratio of the individual phases can be variable in wide ranges. In the P/O/W emulsion ultimately obtained, the weight fraction of the P/O emulsion is preferably 0.01% to 80% by weight, more preferably 0.1% to 70% by weight, and in particular 1% to 30% by weight, based on the overall P/O/W emulsion.

When the P/O emulsion of the invention is introduced into an O/W emulsion, the fraction of the P/O emulsion is preferably 0.01% to 60% by weight, more preferably 0.1% to 40% by weight, and in particular 1% to 30% by weight, based on the P/O/W emulsion ultimately obtained. In the O/W emulsion used for this purpose, the oil fraction is preferably 1% to 80% by weight, more preferably 1% to 30% by weight, based on the O/W emulsion employed. In lieu of a P/O emulsion it is also possible to use a W/O emulsion, leading to a W/O/W emulsion. The individual phases of the emulsions may further comprise ingredients that are customary and known for the individual phases. By way of example the individual phases may comprise further active pharmaceutical or cosmetic compounds that are soluble in said phases. The aqueous phase, for example, may comprise organic soluble sunscreen agents, hydrophilically coated micropigment, electrolytes, alcohols, etc. Some or all of the phases may further comprise solids, preferably selected from pigments or micropigments, microspheres, silica gel, and similar substances. The oil phase may comprise, for example, organically modified clay minerals, hydrophobically coated (micro)pigments, organic, oil-soluble sunscreen agents, oil-soluble active cosmetic compounds, waxes, metal soaps such as magnesium stearate, vaseline or mixtures thereof. (Micro)pigments include titanium dioxide, zinc oxide and barium sulfate and also wollastonite, kaolin, talc, $Al_2O_3$, bismuth oxychloride, micronized polyethylene, mica, ultramarine, eosine colors, and azo dyes. Titanium dioxide or zinc oxide in particular are commonplace sunscreen agents in cosmetology and can be applied particularly smoothly and uniformly to the skin by means of the emulsions of the invention. Microspheres or silica gel can be used as vehicles for active compounds, and waxes may be used, for example, as a base for polishes.

The water phase may further comprise glycerol, polyethylene glycol, polypropylene glycol, ethylene glycol, and similar compounds, and also derivatives thereof.

The use of customary auxiliaries and additives in the emulsions is known to the skilled worker.

As the aqueous phase it is possible to use water, aqueous solutions or mixtures of water with water-miscible liquids such as glycerol or polyethylene glycol. The aqueous phase may also contain electrolytes such as sodium chloride. If desired it is possible additionally to use viscosity enhancers or charge carriers, as described in EP-B-0 605 497.

The invention is elucidated in more detail by the examples below.

EXAMPLES

All experiments were conducted in a two-stage device, with phase A and phase B being fed separately into the first mixing vessel and then the discharge and phase C being fed separately into the second mixing vessel. The stated percentages are based on weight. Particle sizes and internal surface areas were determined using a particle size analyzer (PSA).

Formula examples for continuous emission production

Example 1

Emulsification of a Triglyceride

| | | | |
|---|---|---|---|
| | Phase A: | | |
| Protelan LS 9011 | sodium lauroyl sarcosinate | 0.54% | 0.54% |
| Brij 35 P Nena | laureth-23 | 1.40% | 1.40% |
| Pricerine 9091 | glycerol | 6.32% | 1.40% |
| demin. water | | 2.25% | 2.10% |
| | Phase B: | | |
| Miglyol 812 N | caprylic/capric triglyceride | 60.0% | 60.0% |
| | Phase C: | | |
| demin. water | | 29.5% | 34.3% |
| | | 100.0% | 99.7% |
| speed setting 1 [min-1] | | 4000 | 4000 |
| speed setting 2 [min-1] | | 3200 | 3200 |
| residence time setting 1 [s] | | 10 | 10 |
| residence time setting 2 [s] | | 5 | 5 |
| | PSA | | |
| median [μm] | | 0.39 | 0.44 |
| <1 μm [%] | | 100.0 | 98.3 |
| $cm^2/cm^3$ | | 16.5 | 15.3 |

Example 2

Emulsification of an Alkyd Resin

| | | Sample |
|---|---|---|
| | Phase A: | |
| Protelan LS 9011 | sodium lauroyl sarcosinate | 0.40% |
| Brij 35 P Nena | laureth-23 | 1.05% |
| Hexylene glycol | hexylene glycol | 1.50% |
| demin. water | | 4.50% |
| | Phase B: | |
| Woleekyd L3 | alkyd resin | 58.0% |
| | Phase C: | |
| demin. water | | 34.5% |
| | | 100.0% |
| speed setting 1 [min-1] | | 3000 |
| speed setting 2 [min-1] | | 2400 |
| residence time setting 1 [s] | | 25 |
| residence time setting 2 [s] | | 16 |
| | PSA | |
| median [μm] | | 0.39 |
| <1 μm [%] | | 100.0 |
| $cm^2/cm^3$ | | 17.2 |

Example 3

Emulsification of an Acrylate Resin (80% in EEP)

| | | Sample |
|---|---|---|
| | Phase A: | |
| Protelan LS 9011 | sodium lauroyl sarcosinate | 0.38% |
| Brij 35 P Nena | laureth-23 | 0.41% |

-continued

| Sample | | |
|---|---|---|
| Brij 700 | steareth-100 | 0.41% |
| demin. water | | 6.00% |
| Phase B: | | |
| WorleeCryl product | acrylate resin | 63.0% |
| Phase C: | | |
| demin. water | | 29.8% |
| | | 100.0% |
| speed setting 1 [min-1] | | 3000 |
| speed setting 2 [min-1] | | 2400 |
| residence time setting 1 [s] | | 25 |
| residence time setting 2 [s] | | 16 |
| PSA | | |
| median [μm] | | 0.67 |
| <1 μm [%] | | 82.0 |
| $m^2/cm^3$ | | 11.0 |

Example 4

Production of a W/O Emulsion

| Formula No.: Trade name | | % by weight |
|---|---|---|
| Phase A | | |
| Arlacel 1690 | sorbitan oleate, polyglyceryl ricinoleate | 7.00 |
| Isopar L | C10-13 isoparaffin | 3.50 |
| Phase B | | |
| demin. water | | 40.00 |
| NaCl | sodium chloride | 1.00 |
| Phase C | | |
| Isopar L | C10-C13 isoparaffin | 48.50 |
| Total | | 100.00 |
| speed setting 1 [min-1] | | 3750 |
| speed setting 2 [min-1] | | 3000 |
| residence time setting 1 [s] | | 25 |
| residence time setting 2 [s] | | 13 |
| PSA (volume) | | |
| median [μm] | | 0.39 |
| <1 μm [%] | | 100 |
| $m^2/cm^3$ | | 17.3 |

Example 5

Production of a P/O Emulsion

| Formula No. Production date: Trade name | | empty PO [% by weight] |
|---|---|---|
| Phase A | | |
| Dow Corning DC DC 5225 C | cyclomethicone, PEG/PPG-18/18 dimethicone | 13.80 |
| Abil EM 97 | cetyl PEG/PPG-10/1 dimethicone | 5.20 |
| Wacker Belsil CM 040 | cyclomethicone | |

-continued

| Formula No. Production date: Trade name | | empty PO [% by weight] |
|---|---|---|
| Phase B | | |
| Propylene glycol (0.5% NaCl) | propylene glycol | 71.00 |
| Phase C | | |
| Wacker Belsil CM 040 | cyclomethicone | 10.00 |
| Total | | 100.00 |
| speed setting 1 [min-1] | | 3000 |
| speed setting 2 [min-1] | | 2400 |
| residence time setting 1 [s] | | 20 |
| residence time setting 2 [s] | | 18 |
| PSA (volume) | | |
| median [μm] | | 0.71 |
| <1 μm [%] | | 83 |
| $m^2/cm^3$ | | 9.97 |

Example 6

Production of a Base OW

| Formula No.: Trade name | | [% by weight] |
|---|---|---|
| Phase A | | |
| Biobase RS | glyceryl stearate, cetyl alcohol, sodium stearoyl lactylate, tocopherol | 2.50 |
| Vara AB | petrolatum | 5.00 |
| Cosmacol EBI | C12-15 alkyl benzoate | 5.00 |
| Cetiol J 600 | oleyl erucate | 3.70 |
| Abil 350 | dimethicone | 1.30 |
| Vitamin E acetate | tocopheryl acetate | 1.00 |
| Phase B | | |
| demin. water | | 3.70 |
| Brij 700 | steareth-100 | 0.50 |
| Keltrol | xanthan gum | 0.30 |
| Phase C | | |
| demin. water | | 77.0 |
| Total | | 100.00 |
| speed setting 1 [min-1] | | 4000 |
| speed setting 2 [min-1] | | 3200 |
| residence time setting 1 [s] | | 20 |
| residence time setting 2 [s] | | 5 |

Example 7

Production of an SLN Emulsion

| Phase A: | | |
|---|---|---|
| Protelan LS 9011 | sodium lauroyl sarcosinate | 0.75% |
| Brij 35 P Nena | Laureth-23 | 1.30% |
| Pricerine 9091 | glycerol | 2.25% |
| demin. water | | 2.25% |

-continued

| | | |
|---|---|---|
| | Phase B: | |
| Cutina CP | cetyl palmitate | 44.8% |
| α-Tocopherol | tocopherol | 11.2% |
| | Phase C: | |
| demin. water | | 37.5% |
| | | 100.0% |
| speed setting 1 [min-1] | | 4000 |
| speed setting 2 [min-1] | | 3200 |
| residence time setting 1 [s] | | 12 |
| residence time setting 2 [s] | | 8 |
| | PSA (area) | |
| median [μm] | | 0.36 |
| <1 μm [%] | | 100.0 |
| $cm^2/cm^3$ | | 16.8 |

The invention claimed is:

1. A method for continuously producing emulsions and dispersions while excluding air, in which at least two fluid streams of at least two phases of the emulsions or dispersions are metered separately and continuously into a mixing vessel which is closed on all sides, and in which they are converted, with agitated input, into an emulsion or dispersion, and the emulsion/dispersion is discharged continuously from the mixing vessel, the agitated input taking place without generating cavitation forces and without high-pressure homogenization, and wherein the at least two fluid streams are metered in a proportion effective to provide a viscoelastic range of the mixture in the mixing vessel.

2. The method of claim 1, wherein the emulsion or dispersion discharged from the mixing vessel and a further fluid stream are metered into a second mixing vessel, which is closed on all sides and from which the desired emulsion or dispersion is discharged.

3. The method of claim 1, wherein the method is used for producing nanoemulsions, nanodispersions or SLN dispersions.

* * * * *